US008371796B2

(12) United States Patent
Runonen

(10) Patent No.: US 8,371,796 B2
(45) Date of Patent: Feb. 12, 2013

(54) APPARATUS FOR STACKING VENEER SHEETS

(75) Inventor: Pekka Runonen, Vantaa (FI)

(73) Assignee: Raute Oyj, Nastola (FI)

( * ) Notice: Subject to any disclaimer, the term of this patent is extended or adjusted under 35 U.S.C. 154(b) by 0 days.

(21) Appl. No.: 13/297,472

(22) Filed: Nov. 16, 2011

(65) Prior Publication Data

US 2012/0128462 A1 May 24, 2012

(30) Foreign Application Priority Data

Nov. 23, 2010 (FI) ..... 20106232

(51) Int. Cl.

| | |
|---|---|
| ***B65G 57/02*** | (2006.01) |
| ***B65G 57/00*** | (2006.01) |
| ***B65G 15/30*** | (2006.01) |
| ***B65H 5/02*** | (2006.01) |

(52) U.S. Cl. ..... 414/793.3; 414/788.9; 414/793.4; 198/626.1; 271/193; 271/180

(58) Field of Classification Search ..... 100/917; 101/389.1; 198/369.7, 418.6, 472.1, 690.1, 198/803.6, 817, 626.1, 626.2, 626.3; 271/180, 271/192–193, 272, 6, 901; 414/788.9, 789, 414/789.1, 790.9, 791.1, 791.6, 792.7, 792.8, 414/792.9, 793, 793.1, 793.2, 793.3, 793.4, 414/793.7, 794, 794.2, 794.3, 794.4, 797.1, 414/799; 226/172, 93

See application file for complete search history.

(56) References Cited

U.S. PATENT DOCUMENTS

| | | | | |
|---|---|---|---|---|
| 3,204,502 | A * | 9/1965 | Fuller et al. | 83/96 |
| 3,256,010 | A * | 6/1966 | Buccicone | 271/221 |
| 3,675,791 | A * | 7/1972 | Russell et al. | 414/794 |
| 3,973,770 | A * | 8/1976 | Montenbruck | 271/272 |
| 6,860,709 | B2 * | 3/2005 | Gunnarsson | 414/793.4 |

FOREIGN PATENT DOCUMENTS

| | | |
|---|---|---|
| EP | 1074 494 A2 | 2/2001 |
| FI | 83503 A | 7/1991 |

* cited by examiner

*Primary Examiner* — Gregory Adams

(74) *Attorney, Agent, or Firm* — Womble Carlyle Sandridge & Rice, LLP

(57) ABSTRACT

An apparatus for stacking veneer sheets is provided, said apparatus comprising conveyor means for delivering veneer sheets to a stacking point and means for placing veneer sheets on a stack to be formed. The conveyor means comprise a first and a second conveyor element disposed on opposite sides of a veneer sheet, said first and/or second conveyor element being provided with magnet elements arranged for cooperation with a conveyor element present on the opposite side, such that the veneer sheet to be fed in between the conveyor elements is pressed with a desired force between the conveyor elements and is movable thereby to a stacking point, which is provided with stopper means for stopping the veneer sheet and with means for releasing the veneer sheet from between the conveyor elements to enable its placement on a stack to be formed.

9 Claims, 3 Drawing Sheets

APPARATUS FOR STACKING VENEER SHEETS

CROSS-REFERENCE TO RELATED APPLICATIONS

This application claims priority from and the benefit under 35 U.S.C. §119 of Finnish Patent Application No. 20106232, filed Nov. 23, 2010, in the Finnish Patent Office, which is hereby incorporated herein by reference in its entirety.

BACKGROUND OF THE DISCLOSURE

1. Field of the Disclosure

Aspects of the present disclosure relate to an apparatus for stacking veneer sheets, said apparatus comprising conveyor means for delivering veneer sheets to a stacking point and means for placing veneer sheets on a stack to be formed.

2. Description of Related Art

When it is desirable to conduct the stacking of veneer sheets automatically, the most common practice today is the use of a stacker designed with a suction belt. Applications also exist, which employ a mechanical stacker, e.g. in a jointer. It comprises belts with a veneer proceeding therebetween, and the stacking is performed by moving the lower belt aside.

The suction belt stacker is a working solution as such, but it takes a considerable amount of electric power as suction must be generated by electric motor-driven fans. It may further cause an environmental hazard by swirling air. An attempt to control this environmental problem has been made by using a filtering station. The fans may additionally cause noise problems. The suction belt stacker may have a limited applicability in terms of stacking thin veneer, e.g. as a result of suction adjustment and the fact that releasing a thin veneer from suction may break the veneer. In addition, the stacking accuracy is poor in a suction belt stacker as the veneer moves forward during the course of stacking and e.g. the inconstant weight of veneer has an impact on where the veneer finally comes to a stop. The stacking accuracy is also influenced by the distance between stack and stacker. The stack must have its top surface relatively far away from the suction belt to prevent the veneer sheet from rising back to the belt as a result of suction. Although regulated by a photocell, the distance nevertheless varies, e.g. the distance between various ends of the stack may be different.

There is no knowledge of a useful mechanical stacker. The drawbacks in today's mechanical stackers, wherein veneer sheets are carried between belts, include slowness, a difficulty in managing to retain the veneer in alignment between the belts, and the entrapment of air underneath the veneer as it settles on a veneer stack.

BRIEF SUMMARY OF THE DISCLOSURE

An objective of the present invention is to provide an improved stacking apparatus, which enables avoiding the prior art drawbacks and performing the stacking quickly and accurately. In order to achieve this objective, an apparatus of the invention is characterized in that the conveying means comprise a first and a second conveyor element disposed on opposite sides of a veneer sheet, said first and/or second conveyor element being provided with magnet elements arranged for cooperation with a conveyor element present on the opposite side, such that the veneer sheet to be fed in between the conveyor elements is pressed with a desired force between the conveyor elements and is movable thereby to a stacking point, which is provided with stopper means for stopping the veneer sheet and with means for releasing the veneer sheet from between the conveyor elements to enable its placement on a stack to be formed.

Preferably, the first conveyor element is configured as a conveyor element above the veneer sheet, comprising a gripping portion, which is adapted to circle along an endless track and which is provided with a magnetizable surface or magnetizable surface segments, and the second conveyor element is configured as a conveyor element below the veneer sheet, comprising magnet elements. A magnetic conveyor may also be the overhead conveyor or both conveyors can be provided with magnet elements.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DISCLOSURE

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

Figure 1:
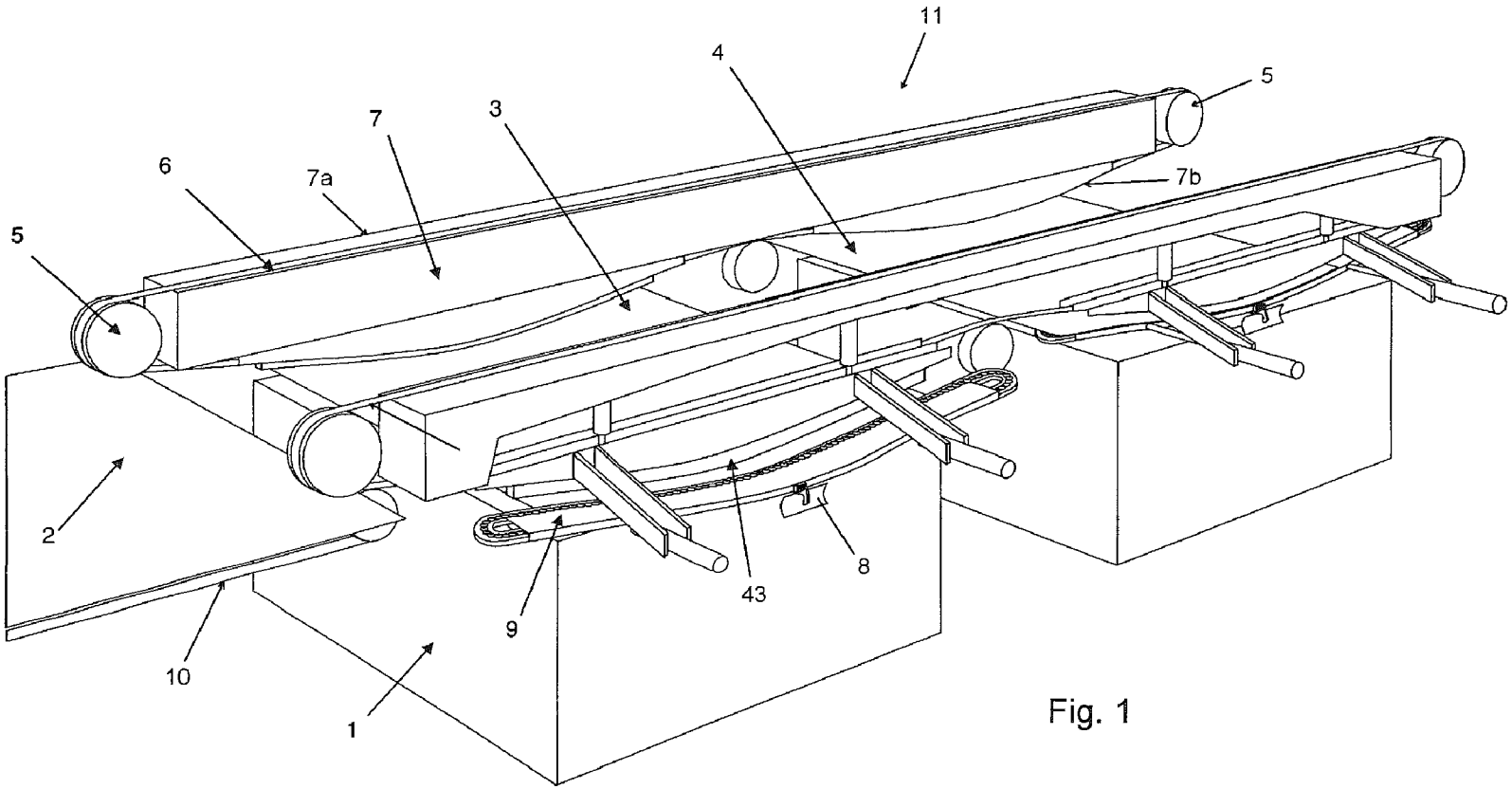
FIG. 1 shows in a schematic view of principle an apparatus of the invention in one embodiment.

FIG. 1 illustrates in a schematic perspective view one embodiment for a stacking apparatus 11 of the invention. Only those parts of the apparatus are depicted which are essential for understanding the invention, since other structures and equipment necessary from the standpoint of operation fall within conventional knowledge one skilled in the art. In FIG. 1, designated with reference numeral 10 is a conveyor belt, whereby veneer sheets 2 for stacking are brought to the stacking apparatus 11. The stacking apparatus 11 includes overhead conveyor belts 6 circling around pulleys 5. In addition, the conveyor belts 6 run along the substantially flat top surface of an enclosure component 7 present inside the belt circle and along the arcuately shaped bottom surface directed towards a veneer sheet to be stacked. The conveyor belt 6 can be e.g. a flat or toothed belt with a magnetizable surface, or e.g. a laminated chain. In the illustrated embodiment, the lower conveyor element consists of a magnetic conveyor, including an enclosure 9. Reference numeral 1 designates a veneer stack. In the illustrated embodiment, the stacking apparatus has two successive stacking points, and reference numeral 3 designates a veneer sheet being presently stacked at the first stacking point and reference numeral 4 a veneer sheet being presently delivered to the second stacking point.

Figure 2:
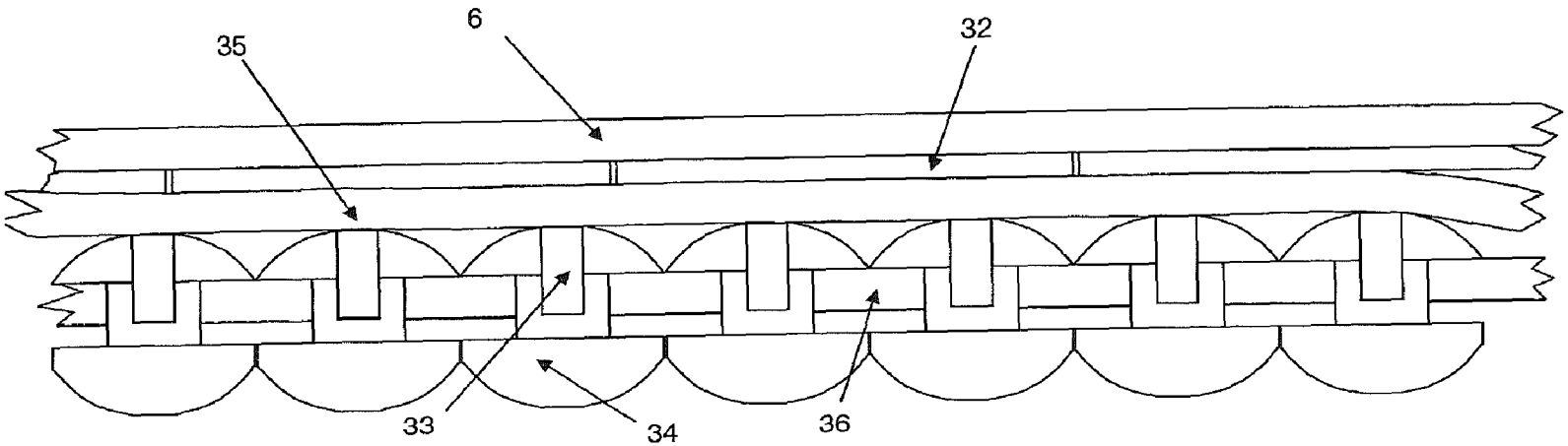
FIG. 2 shows in a larger scale one detail from the exemplary embodiment of FIG. 1.

FIG. 2 is a closer view of the conveyor system used in a stacking apparatus of the invention. Reference numeral 6 designates the overhead conveyor, which is provided with a magnetizable surface or surface segments 32. The veneer sheet is designated with reference numeral 35. The lower magnetic conveyor includes a frame section 36, having permanent magnets 33 fixed thereto by means of attachment studs 34. The permanent magnets are preferably per se known effective neodymium iron boron magnets. It is also conceivable to use electromagnets as magnetic elements. The magnets enable the veneer sheet 35 to be pressed effectively between the overhead belt 6 and the magnets 33. The magnetic conveyor is preferably arranged in a substantially horizontal plane as shown in FIG. 1, but naturally it can also be e.g. in a vertical plane. In addition, the magnetic conveyor is adapted to shift in a direction transverse to the advancing direction of veneer sheets.

Figure 3B:
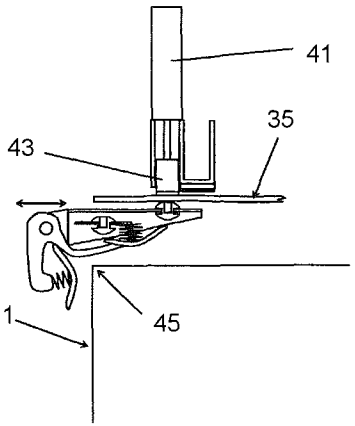
FIGS. 3A-3D show in schematic views of principle various stages of a stacking process in the exemplary embodiment of FIGS. 1-2.
Figure 3D:
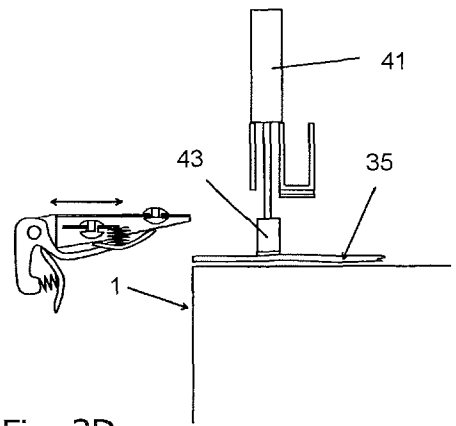
Figure 3A:
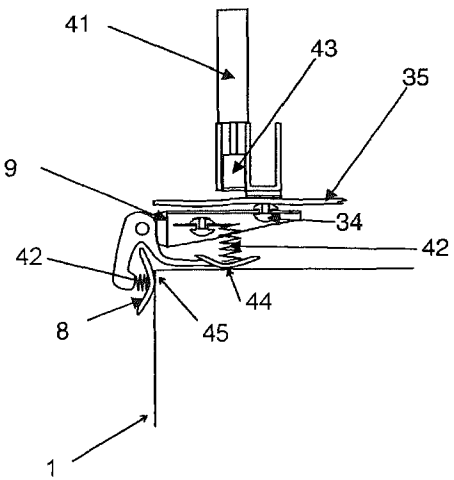

FIGS. 3A-3D illustrate more closely an operating principle for the proposed stacking apparatus at one end of the veneer sheet 35 to be stacked. There is preferably a similar arrangement at the opposite end. FIG. 3A shows a stage, at which the preceding veneer sheet has been set in its position on the stack 1 and the next veneer sheet 35 is presently between the conveyor elements on its way to the stacking point. Once the veneer sheet 35 arrives at the stacking point, the magnets 33 and their enclosure 9 proceed first, as shown in FIG. 3B, to the alignment with a pneumatically operated stacking arm 43. A bottom side of the stacking arm 43 is made of a magnetizable substance. The stacking arm remains stationary in the veneer advancing direction, whereby a veneer sheet is subjected to braking across the entire width of the veneer sheet end and the veneer sheet decelerates its speed quickly and the veneer sheet comes to a stop. This is based on the fact that the magnets are disposed at each end of the veneer sheet along the entire end of the veneer sheet and each magnet has a braking effect. This solution enables veneer sheets to be stopped quickly and accurately.

Figure 3C:
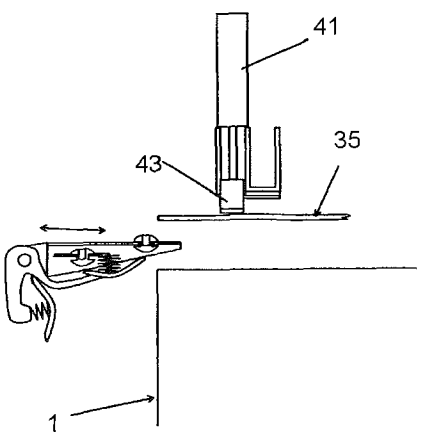

FIG. 3C shows a movement of the magnetic conveyor outward, whereby the magnets disengage from the stacking arm 43. In FIG. 3D, the magnetic conveyor is entirely outside the end of the stack 1 and the stacking arm 43, driven by a cylinder 41, presses the veneer sheet 35 towards the stack 1. Thereafter, the apparatus returns to the position of FIG. 3A and, at the same time, a side aligner 8 and a press element 44 for the stack, both loaded by a spring 42, steer the end of a veneer sheet to the alignment and press the veneer stack between stacking operations in order to keep the veneers stationary.

The stacking arm 43 is preferably arcuate, e.g. in the form of a catenary curve, such that its longitudinal mid-section lies closer to a top surface of the veneer sheet than its leading and trailing end sections. This form is advantageous, because the stacking arm is a small distance away from the stack in the middle and hence the stacking takes as little time as possible. On the other hand, since there is a larger stacking distance at the edges, the air has time to escape from beneath the sheet. In this stacker, the stack can be set in close proximity, since there no fear of the sheet rising back to the conveyor elements, which is a risk in suction belt conveyors.

Many modifications and other aspects of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. An apparatus for stacking veneer sheets, said apparatus comprising conveyor means for delivering veneer sheets to a stacking point and means for placing veneer sheets on a stack to be formed, wherein the conveyor means comprise a first and a second conveyor element disposed on opposite sides of a veneer sheet, one of said first and second conveyor element being provided with magnet elements arranged for cooperation with a conveyor element present on the opposite side, such that the veneer sheet to be fed in between the conveyor elements is pressed with a desired force between the conveyor elements and is movable thereby to a stacking point, which is provided with stopper means for stopping the veneer sheet, said stopper means being provided with a magnetizable surface or magnetizable surface segments for stopping the veneer sheet in a controlled manner in cooperation with the magnet elements of the one conveyor element, and with means for releasing the veneer sheet from between the conveyor elements to enable its placement on a stack to be formed.

2. An apparatus according to claim 1, wherein the first conveyor element is configured as a conveyor element above the veneer sheet, comprising an engagement portion, which is adapted to circle along an endless track and which is provided with a magnetizable surface or magnetizable surface segments, and the second conveyor element is configured as a conveyor element below the veneer sheet, comprising magnet elements.

3. An apparatus according to claim 2, wherein the lower conveyor element is adapted to shift laterally relative to the advancing direction of veneer sheets at a stacking point, such that the magnet elements disengage from the overhead conveyor element and attach to the magnetizable surface or magnetizable surface segments formed on the stopper means for stopping the veneer sheet in a controlled manner.

4. An apparatus according to claim 3, wherein the lower conveyor element is adapted to shift outward from the veneer sheet laterally relative to the advancing direction of veneer sheets, whereby the magnet elements disengage from the stopper means and the lower conveyor element ultimately departs from beneath the veneer sheet allowing the veneer sheet to drop onto the stack to be formed.

5. An apparatus according to claim 2, wherein the lower conveyor element features an engagement surface adapted to circle along an endless track and provided with the magnet elements.

6. An apparatus according to claim 1, wherein the apparatus includes a veneer sheet stacking arm, which is elongated and extends in the advancing direction of veneer sheets, and which is arcuately shaped, such that its longitudinal mid-section lies closer to a top surface of the veneer sheet than its leading and trailing end sections, and which stacking arm is adapted to press the veneer sheet downward at the stacking point.

7. An apparatus according to claim 6, wherein the stacking arm functions also as a stopper means.

8. An apparatus according to claim 1, wherein the apparatus further includes elements for aligning those ends of the veneer sheet, which are transverse to the advancing direction, into coincidence with other veneer sheets included in the stack, and for keeping the stack's topmost veneers stationary between stacking operations.

9. An apparatus according to claim 1, wherein the first conveyor element is configured as a conveyor element above the veneer sheet, comprising an engagement portion, which is adapted to circle along an endless track and which is provided with magnet elements, and the second conveyor element is configured as a conveyor element below the veneer sheet, comprising a magnetizable surface or magnetizable surface segments.

* * * * *